US009851113B2

(12) United States Patent
Clemente

(10) Patent No.: US 9,851,113 B2
(45) Date of Patent: Dec. 26, 2017

(54) AIR DISTRIBUTION SYSTEM FOR INDIVIDUAL COOLING

(71) Applicant: Roger Clemente, Hazlet, NJ (US)

(72) Inventor: Roger Clemente, Hazlet, NJ (US)

( * ) Notice: Subject to any disclaimer, the term of this patent is extended or adjusted under 35 U.S.C. 154(b) by 0 days.

(21) Appl. No.: 14/999,940

(22) Filed: Jul. 18, 2016

(65) Prior Publication Data

US 2016/0327290 A1 Nov. 10, 2016

Related U.S. Application Data

(63) Continuation-in-part of application No. 14/121,930, filed on Nov. 6, 2014, now abandoned.

(51) Int. Cl.

| | |
|---|---|
| ***F25D 23/12*** | (2006.01) |
| ***F25B 21/02*** | (2006.01) |
| ***F24F 5/00*** | (2006.01) |
| ***A45F 3/00*** | (2006.01) |
| ***A41D 13/002*** | (2006.01) |
| ***A41D 13/005*** | (2006.01) |

(52) U.S. Cl.

CPC ..... *F24F 5/0035* (2013.01); *A41D 13/0025* (2013.01); *A41D 13/0056* (2013.01); *A45F 3/00* (2013.01); *F24F 2221/12* (2013.01); *F24F 2221/38* (2013.01)

(58) Field of Classification Search

CPC ..... A41D 27/28; A41D 13/0053; A41D 13/0025; A41D 13/0056; A61F 2007/006; A61F 2007/0064; A61F 2007/0065; A61F 2007/0067; F24F 5/0035; F24F 2221/12; F24F 2221/38

USPC ..... 62/259.3, 259.4, 3.5

See application file for complete search history.

(56) References Cited

U.S. PATENT DOCUMENTS

| | | | | |
|---|---|---|---|---|
| 7,231,777 | B1 * | 6/2007 | Arnold | F24F 1/025 62/259.3 |
| 2001/0000849 | A1 * | 5/2001 | Siman-Tov | A41D 13/0056 62/259.3 |
| 2007/0118956 | A1 * | 5/2007 | Sawicki | A41D 13/0025 2/69 |
| 2007/0271939 | A1 * | 11/2007 | Ichigaya | A41D 13/0025 62/259.3 |
| 2010/0087901 | A1 * | 4/2010 | Hernandez | A61F 7/00 607/107 |
| 2010/0236267 | A1 * | 9/2010 | Korytnikov | F24F 5/0035 62/259.3 |
| 2011/0005236 | A1 * | 1/2011 | Chang | A41D 13/0025 62/3.5 |
| 2012/0203311 | A1 * | 8/2012 | Clemente | A61F 7/00 607/96 |

* cited by examiner

*Primary Examiner* — Joseph Trpisovsky

(74) *Attorney, Agent, or Firm* — Patterson + Sheridan, LLP

(57) ABSTRACT

A portable, adjustable, and flexible waist mounted, self-contained air distribution system for an individual which can distribute pressurized air over the upper or lower body of an individual, directly against the skin or the clothing of the individual, the system including a portable rechargeable battery operated blower fan in communication with a plenum and manifold, the manifold having a primary adjustable and flexible exhaust outlet openings that spreads, throws and disburses a pressurized air flow selectively over the upper or lower body of an individual, thereby allowing air to selectively provide a cooling and evaporate effect.

15 Claims, 5 Drawing Sheets

AIR DISTRIBUTION SYSTEM FOR INDIVIDUAL COOLING

RELATED APPLICATIONS

Applicant claims the benefit of application Ser. No. 14/121,930, filed Nov. 6, 1014, which claimed the benefit of provisional application Ser. No. 69/962,798, filed Nov. 18, 2013.

BACKGROUND OF THE INVENTION

1. Field of the Invention

The present invention relates to a self-contained air distribution system for particular use by an individual to prevent heat stress and fatigue by evaporating body moisture and perspiration when exposed to high ambient temperature. The present invention as described has a particular cooling and evaporative effect.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights.

2. Description of the Prior Art

Individuals are oftentimes required to perform physical activity or duty in ambient atmosphere which is conducive to perspiration. Construction workers in hot climates oftentimes find themselves in such situations.

Other individuals performing in such ambient temperatures are not often allowed the luxury of rest breaks and the like. These include military personnel, which are often required to wear tactical protective vests and multiple layers of clothing, in addition to the personal military equipment they must carry with them. Similar workers that are involved in hazardous waste clean up, or fire fighting, have to wear protective gloves, boots, and outer clothing, together with protective headgear and face masks. These individuals are subjected to substantial fluid loss due to the clothing they are wearing, the equipment they are carrying, and the ambient thermal atmosphere.

Therefore there has been a need for a self-contained apparatus which can be worn by an individual in such conditions which is light weight, comfortable, and distributes air flow about the body of the individual, including the chest and the back and head and the legs. Such a system needs to be responsive to the body movement and not be subject to shut down or collapse by the movement of the body. That is, the individual should be able to lie on his stomach, lie on his back, or sit with his back against a rigid object without the system shutting down or ceasing the distribution and flow of air about the body.

Cooling garments have been widely explored and include systems which attempt to blot the moisture and perspiration from the body, as well as incorporation an air flow system which is incorporated within a protective vest to distribute air yet such a system compromises the performance of the protective vest.

There are numerous personal cooling systems to prevent heat overload and stress. The advantages, methods and construction have been well documented. Currently, vest or garment systems that keep the body cool use phase change material, air, compressed gas, ice, water or a circulating refrigerated liquid. U.S. Pat. No. 6,257,011 B1 to Siman-Tov, et al. teaches an air moving channel sheet capable of absorbing evaporative liquid. U.S. Pat. No. 6,874,332 B2 to Forgach teaches a vest having a fan to discharge air through its elongated housing. U.S. Pat. No. 5,533,354 to Pirkle teaches a harness constructed of perforated tubing which uses a gas to circulate air over the body.

None of the above have a portable, stand alone, pressurized, adjustable, flexible discharge outlet air system that is capable of channeling the exhausting air directly or indirectly over the body or the skin of an individual through adjustable, flexible, waist mounted primary exhaust outlet openings that spreads, throws and disburses pressurized air over the upper or lower body.

Applicant's system is a lightweight plenum manifold system which spreads, throws and distributes a flow of pressurized air about the upper or lower body, of an individual, the flow of air itself capable of cooling the skin directly or the clothing worn by the individual by providing a pressurized air stream that evaporates moisture and perspiration.

The system includes a self-contained portable rechargeable battery operated blower fan assembly capable of producing a high velocity air flow stream, having a plenum, a manifold, and conduits in communication with an auxiliary water evaporation means to distribute pressurized ambient or climate controlled moisturized air directly or indirectly against the skin or clothing of an individual through adjustable, flexible primary exhaust outlet openings attached to the body. As the air exits and passes over the skin or clothing, it provides a cooling effect by evaporating body moisture. The apparatus may be worn beneath the clothing or exterior to the clothing.

The self contained air distribution system, being portable and lightweight, does not present a significant load to the individual with respect to other equipment or garments which may be carried or worn. The protective garments, equipment or clothing required by an individual can be worn over the self-contained cooling system.

OBJECTS OF THE INVENTION

An object of the present invention is to provide for a portable self-contained air transfer system which can be worn by an individual about the waist, either under the user's clothing directly against the skin or over the clothing, the pressurized system distributing air about the skin or body of the user or upon the clothing of the user.

A further object of the present invention is to provide for a novel portable, adjustable, flexible, pressurized air transfer system which is lightweight and which can be easily and comfortably worn beneath the clothing and equipment of the individual.

A still further object of the present invention is to provide for a novel portable, adjustable, flexible, pressurized air transfer system which is responsive to the movement of the body.

A still further object of the present invention is to provide for a novel portable, adjustable, flexible, pressurized air transfer system which allows the individual to perform normal bodily movement, such as sitting, lying prone, lying supine, without affecting the integrity of the system or interrupting the flow of air.

A still further object of the present invention is to provide for a novel portable, adjustable, flexible, pressurized air transfer apparatus which distributes ambient or climate controlled moisturized air flow, that evaporates moisture, cooling the body or the skin, or drying the clothing of an individual.

A still further object of the present invention is to provide for a novel portable self-contained pressurized air distribution system which can be independently worn with or without clothing, the discharge system distributing air about the desired portion of the body.

A still further object of the present invention is to provide for a novel portable, adjustable, flexible, pressurized air transfer system which is responsive to the movement of the body of the individual.

A still further object of the present invention is to provide a novel portable pressurized air distribution system that is independent of incorporation in harnesses, garments or vests to hold it in place and easily adjust to the users size and be positioned about the body.

A still further object of the present invention is to provide for a novel portable pressurized air distribution system that evaporates body moisture by the movement of air through primary exhaust outlet openings.

A still further object of the present invention is to provide a novel portable pressurized air distribution system that can use moisturized ambient air to cool the skin of an individual.

SUMMARY OF THE INVENTION

A portable, adjustable, flexible, waist mounted, self-contained air distribution system for an individual which can spread, throw and distribute pressurized air from waist mounted, adjustable, flexible exhaust outlets over the upper or lower body of an individual, directly against the skin or the clothing of the individual, the system including a rechargeable battery operated blower fan in communication with a plenum and manifold, the manifold connected to waist mounted primary exhaust outlet openings discharging an air flow selectively over the upper or lower body of an individual, thereby allowing air to selectively provide a cooling and evaporate effect.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
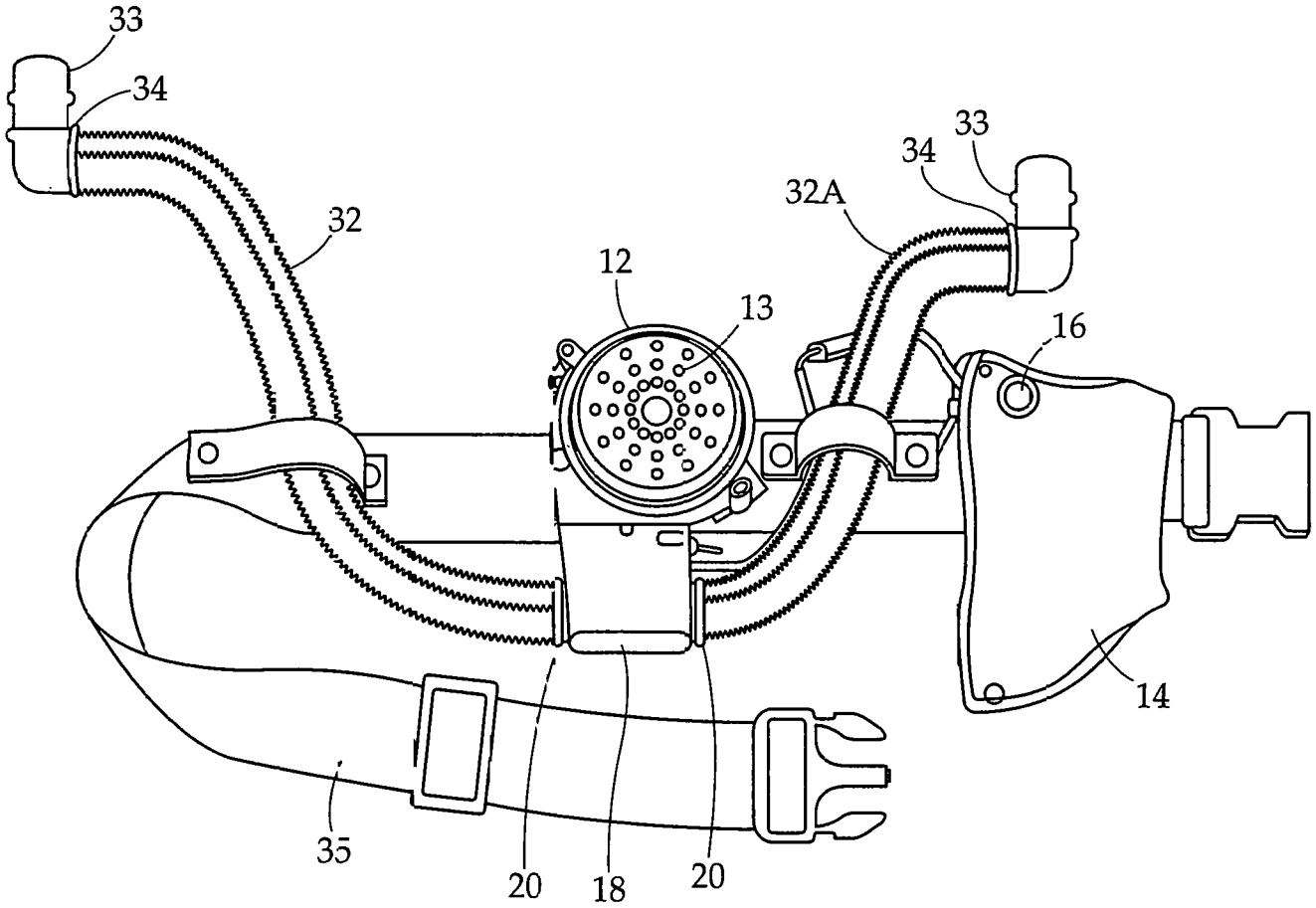
FIG. 1 is a front planar view of the portable self-contained air distribution system of the present invention.

FIG. 1 is a front view of the portable self-contained air distribution system of the present invention. The portable self-contained air distribution system 10 is described initially with respect to its adaption to use by a human individual who is required to perform physical activity in ambient atmosphere which is conducive to excessive perspiration. This would include construction workers, astronauts, military personnel, hazardous waste clean up individuals, fire fighters, and others who oftentimes are required to wear substantial protective clothing and equipment. The distribution of air by the system will have a cooling and evaporative effect on the individual wearing the system, either directly to the skin or the clothing. It will also be understood that while the preferred embodiment is illustrated with two adjustable, flexible waist mounted distribution exhaust outlet openings, the system can be operated with a single adjustable, flexible distribution exhaust outlet opening or more than two adjustable distribution exhaust outlet openings without departing from the spirit and scope of the invention.

The portable self-contained pressurized air distribution system 10 as illustrated in FIG. 1 is adapted for human use. The system may comprise an outer protective shell (not shown) to shield the contents from dirt, dust, and particulate matter. The outer protective shell is formed with an optional filter aperture. Positioned within the optional outer protective shell is an electric blower fan assembly 12 and inlet port 13 that is energized by a portable rechargeable battery pack 14 or other power supply that is connected to a selective on/off switch 16. The blower fan assembly is in communication with a plenum manifold 18 having a plurality of outlet ports 20 attached to adjustable, flexible distribution conduits 32 and 32A that are connected to adjustable, flexible primary exhaust outlet openings 33.

Outlet ports 20 have secured thereto primary adjustable flexible adjustable directional conduits 32 and 32A which extend from a respective outlet port to a selected position about the upper or lower body. The select position about the body could be the upper or lower back or the upper or lower chest of an individual. The terminus 34 and 34A of adjustable, flexible directional conduits 32 and 32A is formed with adjustable, flexible exhaust outlet openings 33 which will disburse the air flow from the energized blower fan assembly 12 upwardly or downwardly across the individual's back or across the individual's stomach and chest or legs, either directly over the skin or the clothing, thus providing a cooling and evaporative affect to the individual.

The terminus 34 and 34A of the adjustable, flexible directional conduits 32 and 32A and the adjustable, flexible exhaust outlet openings 33 could be secured to the adjustable belt of an individual, but would preferably be formed on an adjustable belt member 35 which would allow the blower fan assembly 12 to be secured about the waist of the individual, and the terminus 34 of the adjustable, flexible directional conduit and adjustable, flexible exhaust outlet openings 33 being secured to a position on belt member 35 so as to position the adjustable, flexible exhaust outlet opening member 33 in a desired direction at the small or mid portion of the individual's back or alternatively on the midpoint of the stomach or chest of the individual. Adjustable, flexible exhaust outlet openings 33 in the figures are illustrated as being circular in cross section, however, they may also incorporate a fan shape to disburse the flow of air, or a T-shaped or Y-shaped fitting to simultaneously distribute air flow in a plurality of directions.

By securing the blower fan assembly 12 and adjustable, flexible directional conduits 32 and 32A and adjustable, flexible exhaust outlet openings 33 to its own independent belt or harness 35, allows for the ease of and facility in securing the apparatus about the individual's waist before the individual is required to dress in the particular uniform, garment or clothing required for the particular task to be performed by the individual.

Figure 2:
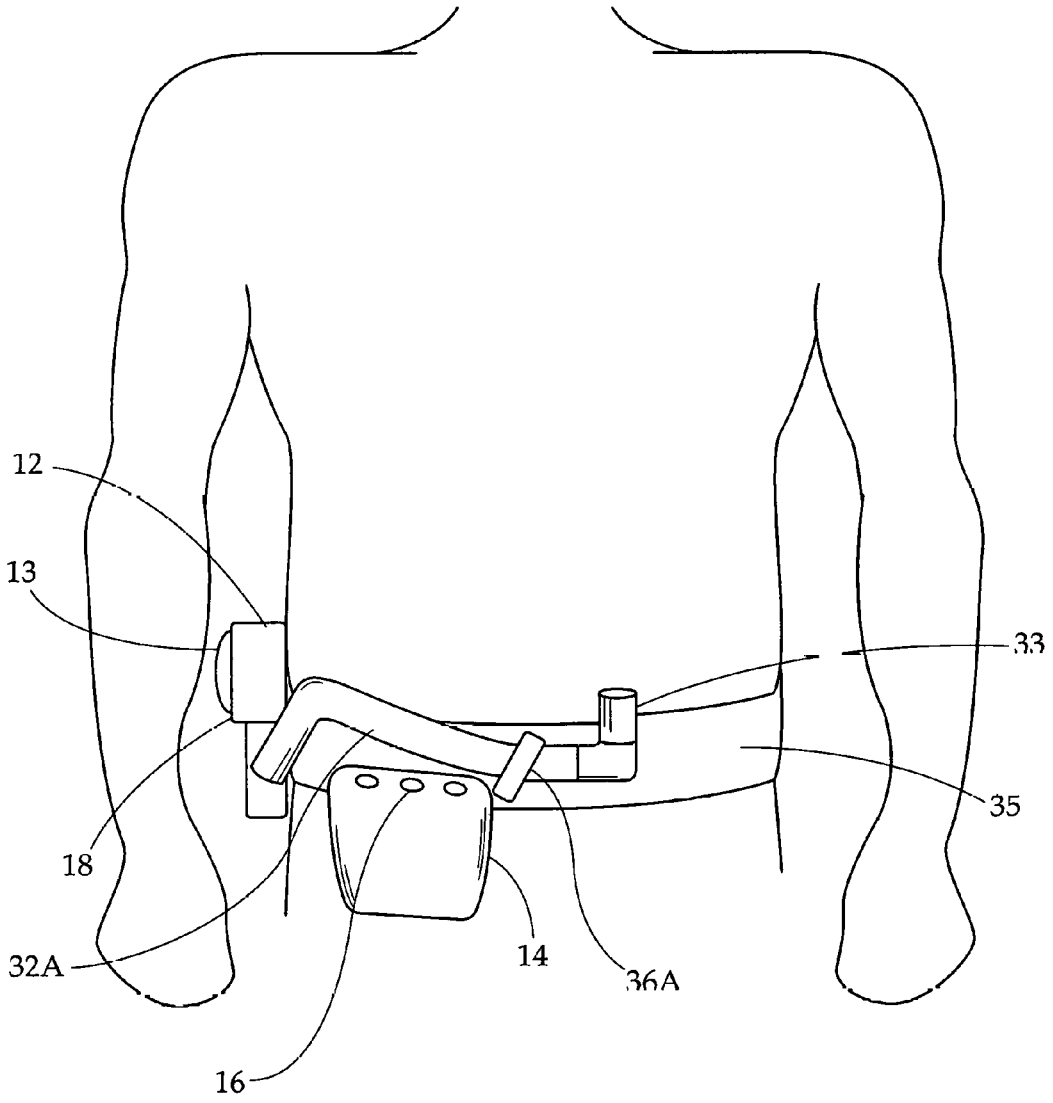
FIG. 2 is a front view of the portable self-contained air distribution system positioned about the torso of an individual.
Figure 3:
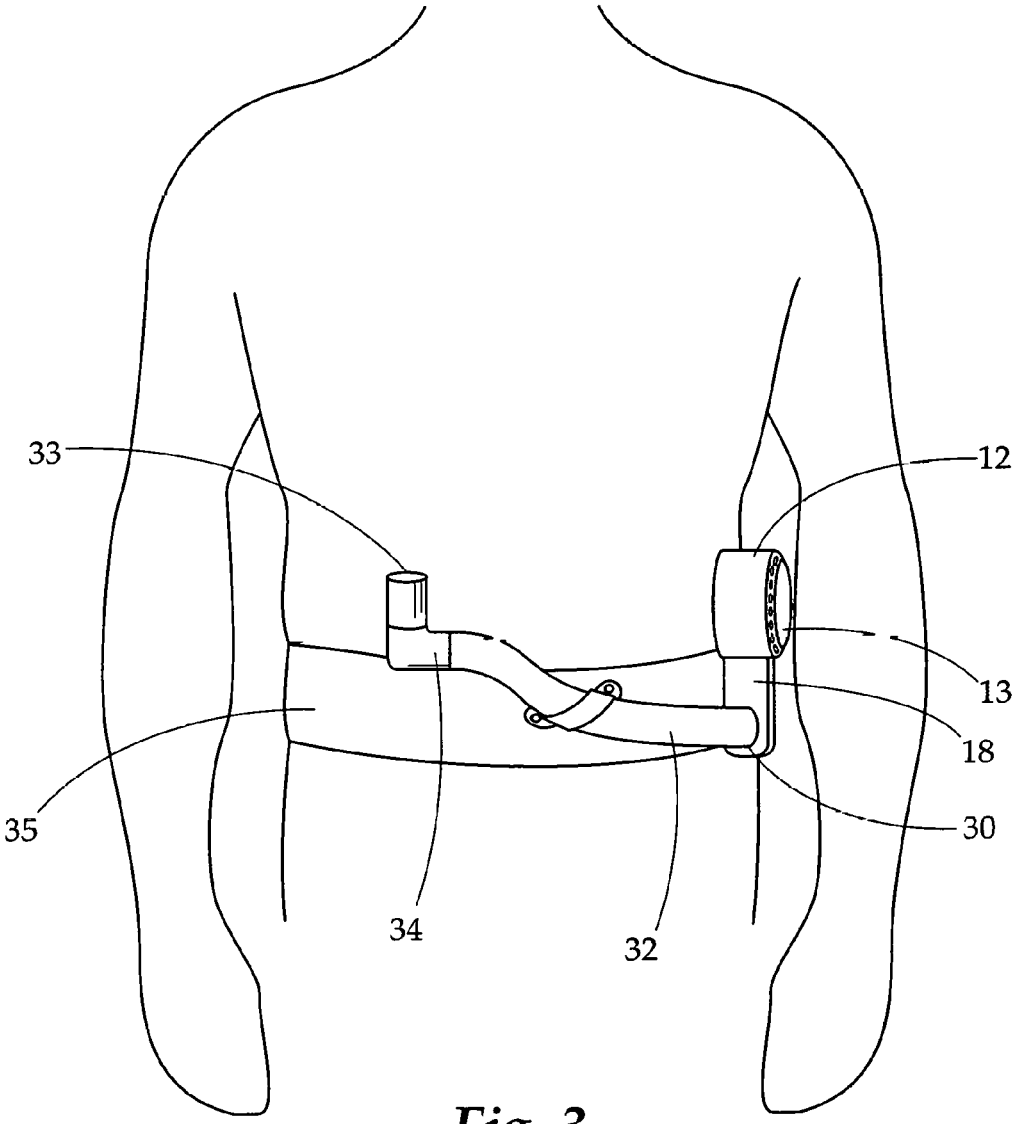
FIG. 3 is a rear view of the portable self-contained air distribution system disposed about the torso of an individual.

FIG. 2 is a front view of an individual illustrating the air distribution system positioned with adjustable, flexible exhaust outlet openings 33 on the stomach of the individual, and FIG. 3 is a rear view of an individual illustrating the self-contained air distribution system positioned with an adjustable, flexible exhaust outlet opening member 33 at the middle of the back of the individual. In both instances, when the blower fan is energized, it moves air through adjustable, flexible directional conduits 32 and 32A, portable exhaust outlet openings 33 and terminus 34 and 34A in a direction across the back and chest of an individual.

Figure 4:
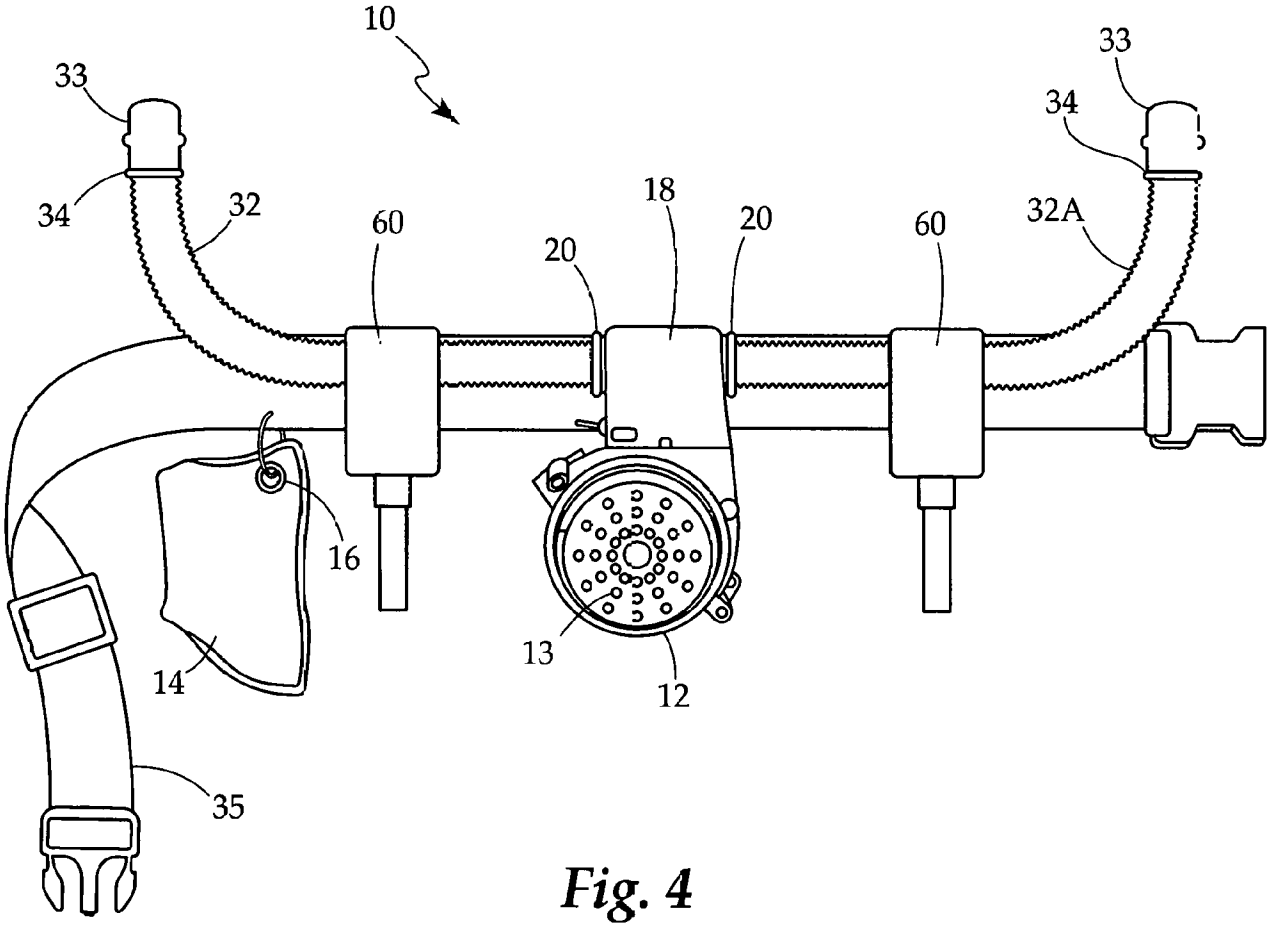
FIG. 4 is a planar view of the portable self-contained air distribution system of the present invention illustrating an optional evaporative system incorporated with the air distribution system to control the humidity of the air stream.

FIG. 4 is a planar view of the belt mounted, portable air distribution cooling system 10 as illustrated in FIG. 1 with the addition of a plurality of water evaporating members 60 secured to distribution conduits 32 and 32A. FIG. 4 also illustrates the adjustability of adjustable, flexible primary exhaust openings 33 illustrating one of the adjustable, flexible primary exhaust outlet openings facing upwardly and the opposing adjustable, flexible primary exhaust outlet opening facing downwardly. As stated, the water evaporative member 60 may be positioned in a variety of locations on the portable self-contained air distribution system 10 and for explanatory purposes is illustrated in FIG. 4 as positioned on adjustable, flexible distribution conduits 32 and 32A.

Figure 5:
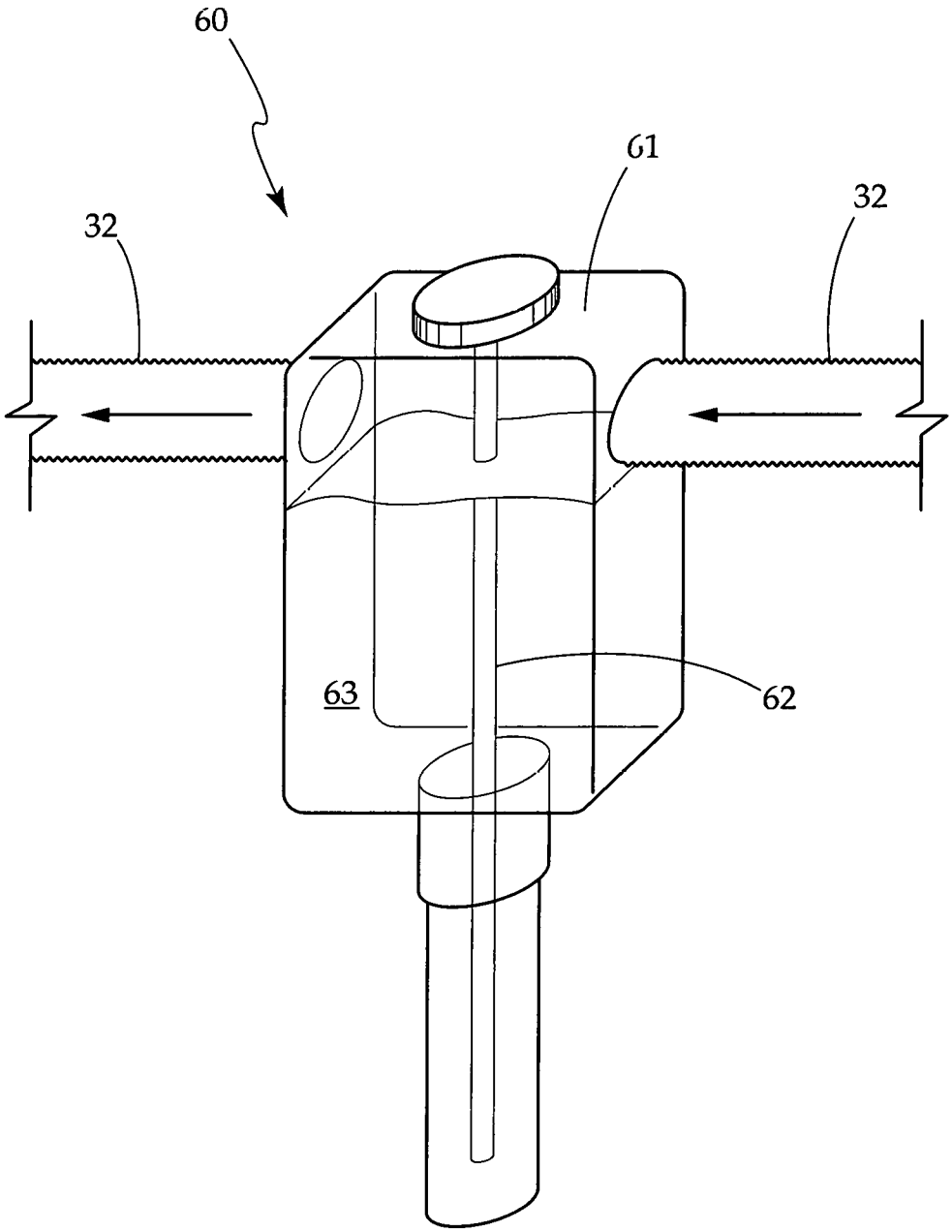
FIG. 5 is a cross-sectional view of one of the evaporative members illustrated in FIG. 4.

FIG. 5 is a cross-sectional view of one of the water evaporative members 60.

A water evaporating member 60 comprised of a water container 61 having an absorbent wick type material 62 extending there from may be connected to the plenum manifold 18 or adjustable, flexible outlet conduits 32 and 32A or to the adjustable, flexible primary exhaust outlet openings 33. The wick type material 62, by capillary actions, can draw water 63 from the container 61 into either plenum chamber 18, adjustable, flexible outlet conduits 32 and 32A as shown, or adjustable, flexible primary exhaust outlet openings 33. As the air flow created by blower fan assembly 12 passes over the moisturized absorbent wick type material 62, it increases humidity by evaporative cooling, thereby lowering the ambient air temperature as it passes through the primary adjustable, flexible exhaust outlet openings 33.

The belt mounted portable air distribution cooling system for an individual as described herein has been illustrated with adjustable, flexible primary exhaust outlet openings positioned on both the back and front of the individual's body. It will be recognized by one of ordinary skill in the art that numerous modifications can be made without departing from the scope of the invention. An assembly could have single or multiple adjustable, flexible conduits 32 and 32A. Conduits 32 and 32A may have a fixed length or may also be positioned in different planes. The air distribution system may also be attached to means other than a belt and the adjustable, flexible primary exhaust outlet openings could be positioned in a different orientation, such as downwardly.

The portable self-contained distribution system being light weight does not present a significant load to the individual with respect to other equipment or garments which he may be carrying or wearing. The protective garments, equipment, or clothing required by the individual would be worn over the self-contained distributive evaporating system.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. A portable, adjustable air distribution system for the purpose of reducing an individual's body heat load, the system comprising:

a portable pressurized air flow source having a power supply, said pressurized air flow source in communication with an inlet to a plenum manifold, said plenum manifold having coupled to a plurality of adjustable, flexible directional air passageway conduits for channeling ambient exhaust air from said plenum manifold through the air passageway conduits to termini, the termini coupled to a plurality of one or more adjustable, flexible waist mounted primary exhaust outlet openings that selectively spreads, throws and disburses pressurized air through the adjustable, flexible primary exhaust outlet openings, the adjustable, flexible primary exhaust outlet openings directionally adjustable relative to the air passageway conduits.

2. The portable adjustable air distribution system in claim 1 wherein said pressurized air flow source having said power supply comprises a portable, rechargeable energized battery configured to power a blower fan having an inlet and an outlet, said blower fan outlet in communication with said inlet of said manifold.

3. The portable adjustable air distribution system in accordance with claim 1 wherein said plurality of one or more adjustable, flexible directional air passageway conduits extend outwardly from said plenum in a substantially horizontal orientation terminating with one of said adjustable, flexible exhaust outlet openings.

4. The portable adjustable air distribution system in accordance with claim 3 wherein said air distribution system is waist mounted and said adjustable, flexible primary exhaust outlet openings are attached to an adjustable waist belt member.

5. The portable adjustable air distribution system in accordance with claim 1 wherein said pressurized air flow can be ambient or climate controlled air.

6. The portable adjustable air distribution system in accordance with claim 5 wherein said climate control air is produced by a water evaporating cooling member incorporated in said plenum manifold, said adjustable, flexible air passageway conduits, or said adjustable, flexible exhaust outlet openings.

7. The portable adjustable air distribution system in accordance with claim 6 wherein said climate controlled air produced by said water evaporating cooling member is comprised of a capillary action wick that draws water from a fluid container moisturizing said pressurized air.

8. The portable adjustable air distribution system in accordance with claim 1 wherein said plurality of one or more adjustable, flexible directional air passageway conduits are adjustable and flexible in both position and length.

9. The portable adjustable air distribution system in accordance to claim 1 wherein said plurality of one or more adjustable, flexible waist mounted primary air exhaust outlets that extend downwardly.

10. The portable adjustable air distribution system in accordance with claim 1 wherein said portable adjustable, flexible air distribution system is capable of cooling multiple portions of a body at the same time.

11. The portable adjustable air distribution system in accordance with claim 1 wherein said portable adjustable, flexible air distribution system is adjustable and flexible and can be worn directly against said individual's body or worn over clothing.

12. The portable adjustable air distribution system in accordance with claim 1, wherein the adjustable, flexible directional air passageway conduits are configured to provide substantially all flow passing therethrough to the termini.

13. The portable adjustable air distribution system in accordance with claim 1 further comprising:

an absorbent wick configured to draw fluid by capillary action into the plenum chamber.

14. The portable adjustable air distribution system in accordance with claim 1 further comprising:

an absorbent wick configured to draw fluid by capillary action into the adjustable, flexible outlet conduits.

15. The portable adjustable air distribution system in accordance with claim 1 further comprising:

an absorbent wick configured to draw fluid by capillary action into the adjustable, flexible primary exhaust outlet openings.

* * * * *